US006971539B1

(12) United States Patent
Abbe

(10) Patent No.: US 6,971,539 B1
(45) Date of Patent: Dec. 6, 2005

(54) APPARATUS FOR STORING FOOD

(75) Inventor: Nancy A. Abbe, Scarsdale, NY (US)

(73) Assignee: Saber-Com, Inc., Scarsdale, NY (US)

( * ) Notice: Subject to any disclaimer, the term of this patent is extended or adjusted under 35 U.S.C. 154(b) by 467 days.

(21) Appl. No.: 09/844,627

(22) Filed: Apr. 27, 2001

(51) Int. Cl.[7] ..... B65D 25/04
(52) U.S. Cl. ..... 220/592.13; 220/592.12; 220/662
(58) Field of Search ..... 220/592.12, 592.13, 220/662, 665, 505, 506, 507, 592.26; 40/661, 40/324, 325, 306, 310, 312, 720, 722

(56) References Cited

U.S. PATENT DOCUMENTS

| | | | | | |
|---|---|---|---|---|---|
| 242,805 | A * | 6/1881 | Wooster | 220/592.12 |
| 417,082 | A * | 12/1889 | Pichereau | 211/69.2 |
| 746,264 | A * | 12/1903 | Barhite | 220/592.12 |
| 929,408 | A * | 7/1909 | Drisdale | 220/592.12 |
| 1,147,041 | A * | 7/1915 | Oxley | 220/662 |
| 4,432,151 | A * | 2/1984 | Morris | 40/661 |
| 4,505,059 | A * | 3/1985 | Morris | 40/661 |
| 4,927,041 | A * | 5/1990 | Hepburn | |
| 5,024,210 | A * | 6/1991 | Nelson | |
| 6,062,380 | A * | 5/2000 | Dorney | 206/217 |
| 6,253,918 | B1 * | 7/2001 | Greiner | 206/457 |

* cited by examiner

*Primary Examiner*—Stephen Castellano
(74) *Attorney, Agent, or Firm*—Fish & Neave IP Group Ropes & Gray LLP; Robert W. Morris

(57) ABSTRACT

The present invention provides multi-walled food storage containers in which the cavity between the walls may be filled by individual users. In particular, the present invention provides users with the ability to insert written storage notes, date of storage and/or preparation instructions in between the walls of the container. In this manner, the notes are not subject to smearing, smudging or erasure from mishandling, nor are they susceptible to damage from condensation or frost. The food storage containers may further include designated regions within the multi-walled structure in which one or more regions includes a cellular structure that provides additional rigidity and insulation for long-term storage of food. Alternately, one or more regions between the walls may be filled with a fluid or gas to provide additional insulation.

18 Claims, 6 Drawing Sheets

APPARATUS FOR STORING FOOD

BACKGROUND OF THE INVENTION

This invention relates to food containers for storing food in the freezer and refrigerator and for identifying the contents of the container. More particularly, this invention relates to food containers that provide the capability to effectively store labels with the containers that identify the contents of the containers.

There are many different types of food storage containers available in the market today. Typical food containers are those made by companies such as TUPPERWARE, RUBBER MAID, and GLAD. The known containers come in a variety of sizes, shapes, compositions, colors, durability, and airtight qualities. The variety of sizes and shapes provides many different options in storing various kinds of foods. Sometimes, however, this variety makes it difficult to store the containers efficiently (i.e., in the least amount of space) when they are not in use. For example, bowls of the same size may be efficiently stacked inside a freezer or refrigerator when filled with food, but may not be stored as efficiently because they are less likely to nest inside of each other, and thus take up less space, when not in use.

Moreover, a multitude of different colors and shapes can make it difficult to distinguish what type of food stuffs are contained within the food storage container. In addition, these containers also make it difficult, if not impossible, to discern how long the food stuff has been inside the container. Conventional bookkeeping systems could be used to attempt to keep track of the contents of the containers and the date they were stored in the freezer, but such a task is likely to be time consuming, burdensome, difficult to maintain and difficult to use. When looking in at stored food in a freezer, for example, individuals do not want to have to go to a notebook somewhere to determine the contents of the containers they were just looking at.

As an alternative to developing a food container bookkeeping system, people often simply label their food containers. For example, some people may label containers by writing on the food container itself with crayons, markers, or china marking pencils. These writings, however, often produce unsatisfactory results, at least in part, because of the composition of the container, which is generally plastic. The plastic may cause, for example, the pencil, crayon, or marker to become smeared and illegible, either during the initial writing, while being stored in the freezer, or in subsequent handling of the container. Moreover, attempts to remove these writings, once the container is emptied, usually results in messy smudges on the container, making it harder and harder to properly reuse the container.

Other labeling methods may include applying masking or other tape to the container and using a ball point pen or other writing instrument to write down the contents of the food, date stored and/or any instructions associated with the contents of a particular food storage container. The size of the tape, however, may limit the individual's ability to provide a full description and/or preparation instructions for the food. This can lead to frustration, such as when one cannot remember the next step involved in preparing the stored food for serving because of limited written instructions. Moreover, the masking tape may slip off the container while in the freezer or later on in the refrigerator, or the ink may become smudged or blurred due to condensation, frost, or handling of the container, thus causing the individual great frustration.

Other types of storage containers may include plastic bags such as those offered by ZIPLOCK, the zipper closure plastic bag, or GLAD. But these bags are often not sufficient for storing foods for extended periods of time. For example, plastic bags have been known to leak and permit air to enter into the bag, resulting in freezer burn and other unwanted occurrences. This is even more likely to occur when the bags are used for an extended period of time because the plastic bags simply are not as durable as plastic storage containers. Furthermore, applying labels to plastic bags is usually impractical. The label may not stay put. In fact, some plastic bags are sold which include an exterior region that is specially designated for writing information, such as the date stored. This region, however, is also prone to smudging and erasure.

It is therefore, an object of the present invention to provide methods and apparatus for storing that provide the capability to neatly and effectively label the contents of the storage container.

It is also an object of the present invention to provide methods and apparatus for maintaining food over extended periods of time in an airtight, well insulated storage unit.

It is also an object of the present invention to provide methods and apparatus for storing food that include a multi-walled structure.

It is another object of the present invention to provide methods and apparatus for containing labels within a doubled walled structure of a food storage container.

It is a further object of the present invention to provide methods and apparatus for storing food utilizing a multi-walled structure that includes a cellular structure contained therein that provides additional rigidity and insulation.

It is a still further object of the present invention to provide methods and apparatus for storing food that include a multi-wall structure that may be filled with a fluid or gas.

It is still another object of the present invention to provide methods and apparatus for storing multiple containers using a reduced amount of space when the containers are not in use.

SUMMARY OF THE INVENTION

The above, and other objects of the present invention are accomplished by providing multi-walled food storage containers in which the cavity between the walls may be filled by the individual users. In particular, the present invention provides users with the ability to insert written storage notes, date of storage and/or preparation instructions in between the walls of the container. In this manner, the notes are not subject to smearing, smudging or erasure from mishandling, nor are they susceptible to damage from condensation or frost.

In accordance with the present invention, food storage containers may further include designated regions within the multi-walled structure in which one or more regions includes a cellular structure that provides additional rigidity and insulation for long-term storage of food. Alternately, one or more regions between the walls may be filled with a fluid or gas to provide additional insulation.

Moreover, the food storage containers of the present invention may be configured such that multiple containers can be stored in significantly less space when not being used than the containers require when they are in use.

DETAILED DESCRIPTION OF THE INVENTION

Figure 1:
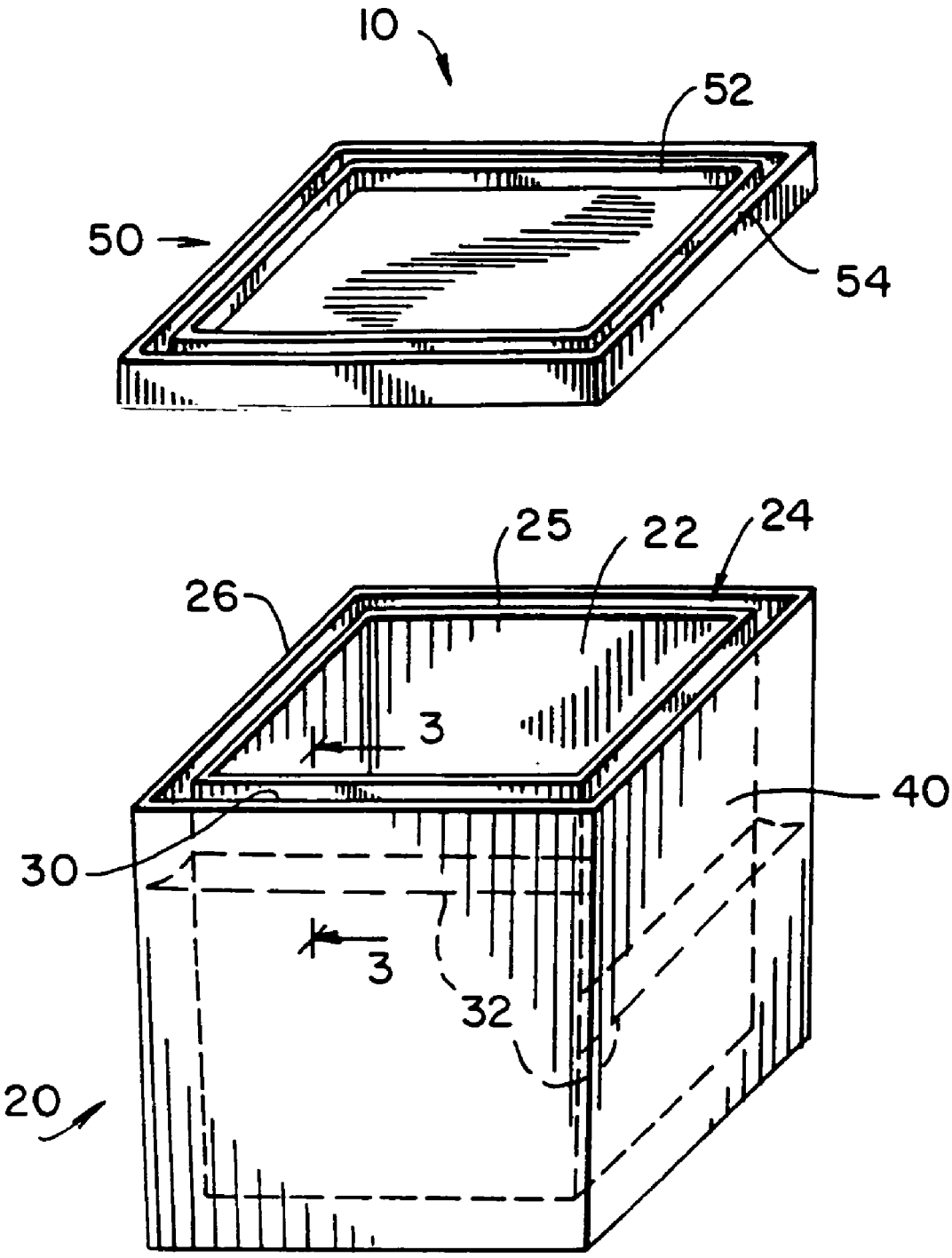
FIG. 1 is an exploded perspective view of a food storage container constructed in accordance with the principles of the present invention.

In accordance with the principles of the present invention, FIG. 1 shows a food storage unit 10 that may be used to store food in a refrigerator or freezer. Food storage unit 10 includes container 20 and lid 50. Container 20 if formed from an inner wall 22 and an outer wall 24, where there is a hollow channel 30 between inner wall 22 and outer wall 24 on at least one side of container 20. For ease of manufacturing, however, it may be practical to form container 20 such that each side of container 20 includes inner wall 22 and outer wall 24. The top of inner wall 22 includes an inner wall lip 25 that may be attached to a corresponding inner wall lip 52 of lid 50. Outer wall 24 likewise includes an outer wall lip 26 that may be attached to a corresponding outer wall lip 54 of lid 50.

Figure 2A:
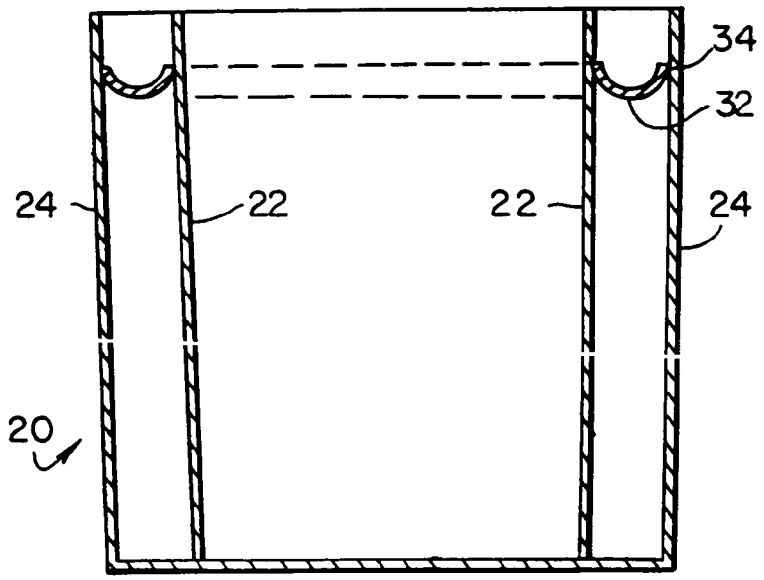
FIGS. 2A and 2B are two alternate embodiments of the wall structure of the food storage container of FIG. 1.
Figure 2B:
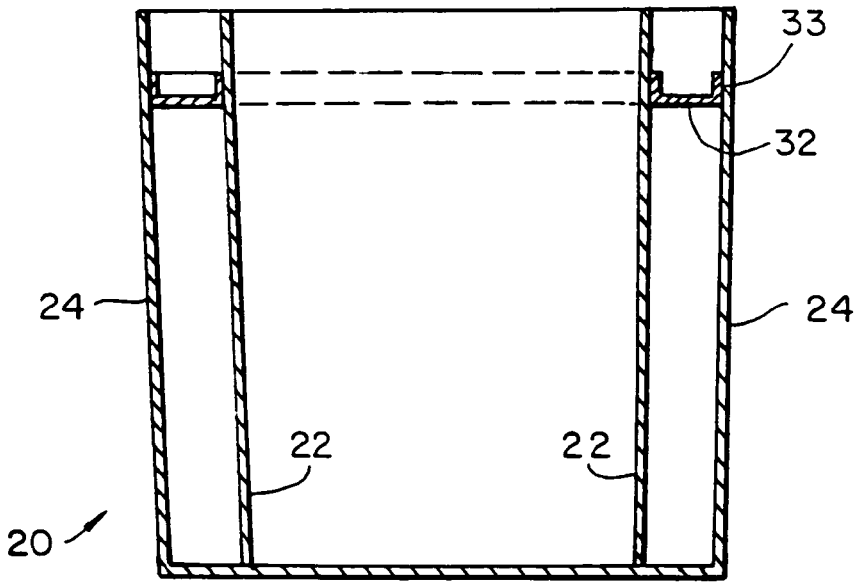

A hollow channel 30 represents the gap of empty space between inner wall 22 and outer wall 24. Hollow channel 30 may vary in depth individually for each side of container 20, or they may all have the same depth. For example, three sides may have a hollow channel depth of one-half inch, while the fourth side has a hollow channel depth of one and a half inches. This enables a user to place a card or other writing in the channel. The actual depth of each channel depth is controlled by the positioning of hollow channel barrier 32 during the manufacturing process. As shown in FIGS. 2A and 2B, hollow channel barrier 32 may have a variety of physical configurations such as squared channel barrier 33, rounded channel barrier 34, or any other suitable type of channel barrier. A squared or rounded channel may be preferable because those shapes would likely be easier to clean if, for example, food happened to fall into hollow channel 30 while being placed in container 20. In addition, the hollow channel may, in accordance with the present invention, be filled with liquid or gas to provide additional insulation to the container.

As shown in FIG. 1, hollow channel 30 provides a space for effectively storing a label or other writing in label container area 40. This label may be used, for example, to describe the contents of the container, to provide future instructions regarding further food preparation, or any other notes related to the food that is placed in the food container (such as the date stored, or a "USE BY" date). While the label may be placed into any of hollow channels 30, it may be most advantageous to place the label in the deepest of hollow channels 30 (i.e., in area 40, as shown in FIG. 1). For example, if the deepest hollow channel 30 has a depth of two inches, a piece of paper or any other suitable label having a height of about two inches may be placed into the area between inner wall 22 and outer wall 24.

The label would thus be contained by inner wall 22, outer wall 24, hollow channel barrier 32, and lid 50, which would itself be attached to inner wall lip 25 and outer wall lip 26. Because the label is fully contained within label area 40, the label is safe from being accidentally misplaced, smeared, smudged or otherwise damaged from handling of the container. Moreover, the label would also be more legible to the user after removal from the freezer or refrigerator then conventional markings, because the label in label area 40 is not directly exposed to the harsh cyclic conditions present in freezers and refrigerators, such as frost. Label container area 40 thus provides an effective way of keeping a label safely with the stored food without obliterating the writing on the label.

Storage container 10 may be formed from any of a variety of materials. For example, container 20 and/or lid 50 may be fabricated out of plastic, wood, STYROFOAM, the polystyrene foam insulation material, metal or any other suitable material for constructing container 20 and/or lid 50. It may, however, be preferable to manufacture container 20 and lid 50 from some form of plastic. The use of plastic for container 20 and lid 50, makes it easier to incorporate one or more colors or mixture of colors. Moreover, it would be advantageous to fabricate at least the portion of outer wall 24 that includes container label area 40 out of a translucent material, so that users can easily read the writing on the label without having to open lid 50 to read the label.

Figure 3:
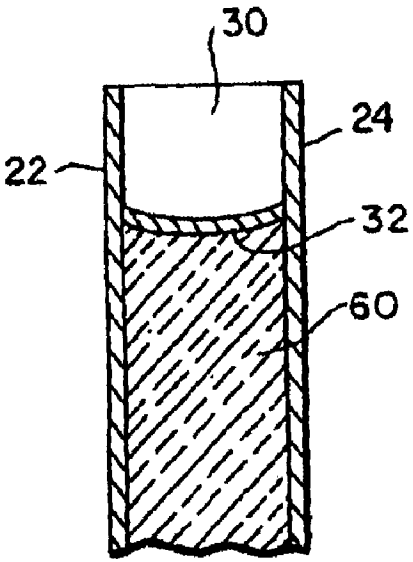
FIG. 3 is a cross-sectional view of the walls of the food storage container of FIG. 1, taken along line 3—3.

FIG. 3 shows an illustrative cross-section of a hollow channel 30 that provides increased thermal protection from the effects of cold storage. In this embodiment, inner walls 22, outer walls 24 and channel barrier 32 may be fabricated in such a way that an insulating material 60 is placed within the closed cavity therein. Insulating material 60 may thus be located within the volume of space below channel barrier 32, as well as on the bottom of the food container. Insulating material 60 may include any insulating material known to persons skilled in the art, such as STYROFOAM, the polystyrene foam insulation material, ceramics, fiberglass, or anything else suitable for providing insulation. Insulation materials 60 may help prevent freezer burn of the food contained within container 20. Insulation material 60 may also provide additional structural support to container 20 by adding rigidity to the walls of container 20.

Figure 5:
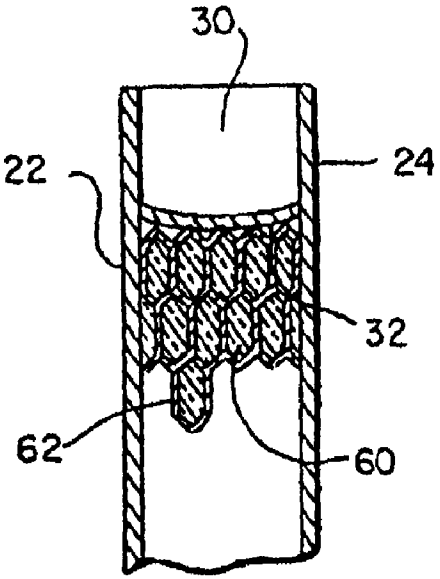
FIG. 5 is a cross-sectional view of another embodiment of internal structure of the walls of the food storage container of FIG. 1, taken along line 3—3.
Figure 4:
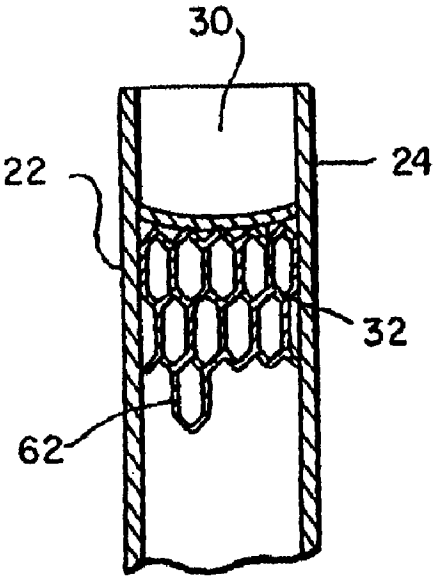
FIG. 4 is a cross-sectional view of another embodiment of internal structure of the walls of the food storage container taken alone line 3—3.

FIG. 4 shows an alternate embodiment of a cross-section of hollow channel 30. In the embodiment shown in FIG. 4, the space between inner wall 22 and outer wall 24 may be filled with a support structure 62 that is contained below hollow channel barrier 32. Support structure 62 provides additional structural integrity to container 20 over that described above with respect to insulation material 60. As shown in FIG. 4, support structure 62 may be cellular, or honeycomb in nature, thereby allowing for individual units to be placed together to form additional structural support in channel 30. Moreover, as shown in FIG. 5, support structure 62 may be used in conjunction with the above-mentioned insulation material 60 to provide both insulation 60 and additional support structures 62 to container 20.

Figure 6:
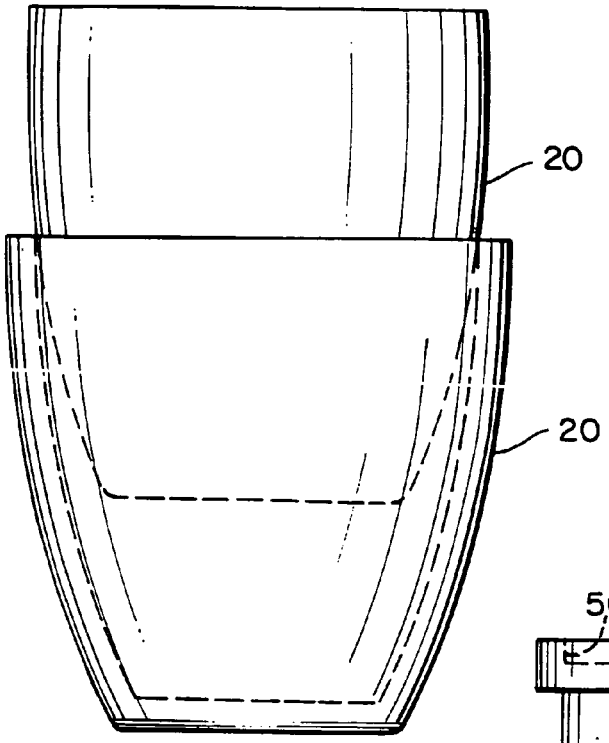
FIG. 6 is a side view illustration of how the food storage containers of the present invention may be stored when not in use.

In another aspect of the present invention, container 20 may be constructed so that multiple containers of differing or the same sizes can easily be stacked on top of and within each other for easy and efficient storage. As shown in FIG. 6, in such a configuration, multiple, different sized stackable containers 20 can be efficiently stored in essentially the space of the largest container, thereby taking up less space in cupboards or cabinets when the containers are not in use. Each container 20 may be shaped in any suitable form that allows the bottom end of the container 20 to be inserted into another container 20, larger sized container. For further efficiency, the different sized containers should be of the same shape.

Figure 7:
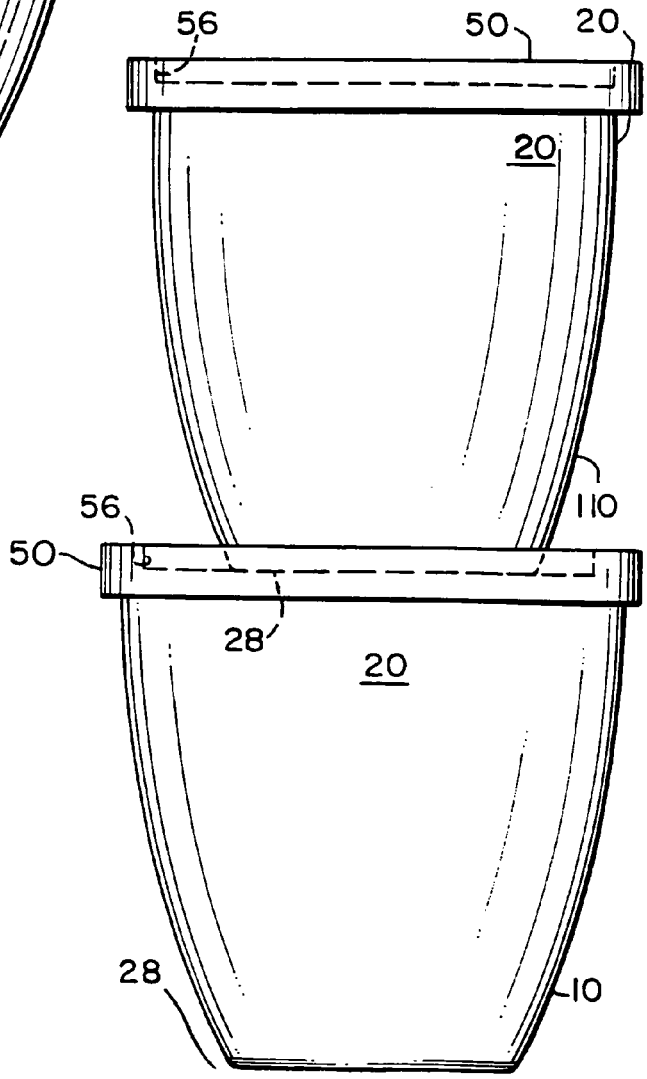
FIG. 7 is a side view illustration of how the food storage containers of the present invention may be efficiently stacked when in use.

Moreover, containers 20 may be constructed to include, for example, a tapered bottom end to further enhance efficiency in stacking and storing. This may be particularly advantageous for storing multiple containers of the same size. A tapered bottom (i.e., where the bottom portion is smaller in diameter than the open, top end of the container), may allow containers 20 to be easily placed on top of each other in stackable fashion, especially when the containers are being used to store food. This is clearly shown in FIG. 7, where the food containers are arranged in a stack in a freezer or a refrigerator. Lid 50 may be configured to include an insert or lip 56 that acts as a stacking support structure and which is specifically designed to hold container bottom 28 of a container 110 in a uniform position on top of container 10 (i.e., the container bottom nestles securely on top of the lid of another food container unit). In this manner, valuable storage space in the freezer or refrigerator is utilized efficiently, and there is less likelihood that spillage will occur.

Figure 8:
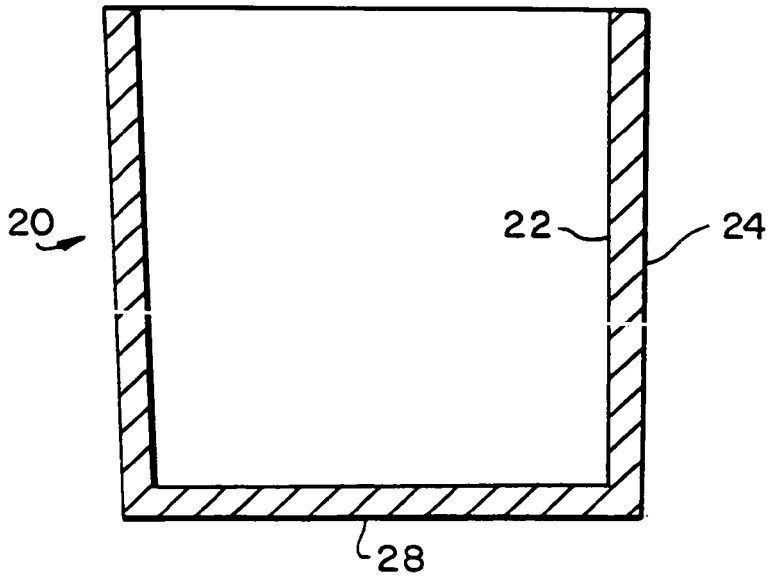
FIG. 8 is a cross-sectional view of one embodiment of the bottom of the food storage container of FIG. 1.

Container bottom 28 can take any one of a variety of different forms. One embodiment of a container bottom 28 includes a single structure that combines inner wall 22 and outer wall 24. For example, FIG. 8 shows a cross-section plan view of a container 20 having a bottom 28 that is formed by unionizing inner wall 22 and outer wall 24 into a single wall. This particular embodiment would not include any insulating material 60 or support structures 62 present in container bottom 28.

Figure 9:
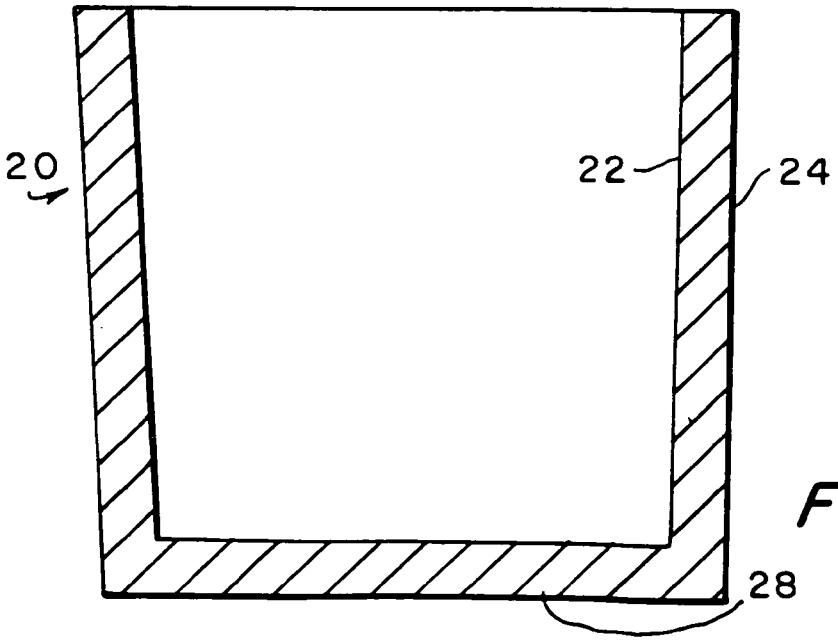
FIG. 9 is a cross-sectional view of another embodiment of the bottom of the food storage container of FIG. 1.

Another embodiment of container bottom 28 may include a "dual walled bottom" in which inner wall 22 and outer wall 24 are both used to form container bottom 28. In this embodiment, as shown in FIG. 9, inner wall 22 and outer wall 24 remain parallel to each other from the one side of the top of container 20, down to bottom 28 and up the other side. The channel between parallel inner wall 22 and outer wall 24 may be formed to include insulating material 60, support structures 62, or insulation support structures 64, as previously described, in accordance with the present invention.

Figure 10:
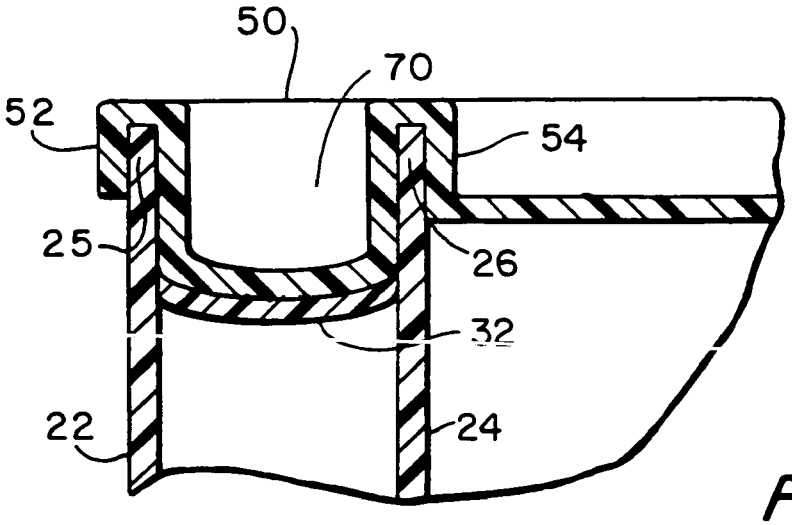
FIG. 10 is cross-sectional view of the assembled wall/lid interface of one embodiment of the food storage container of FIG. 1.

In still another aspect of the present invention, as shown in FIG. 10, the top portion of the container 20 may include lip ends or flanges that interact with lid 50 so that container 20 and lid 50 attach together in a substantially airtight fit. The lips of either inner wall 22, outer wall 24, or both may be configured to provide a uniform lip or flange for lid 50 to interlock with. Alternately, the lips or flanges of each wall may be differently shaped (e.g., inner lip 25 may be a fatter, more rounded lip, while outer lip 26 may be narrower sharper lip), to provide for a substantially airtight seal. Moreover, lips 25 and 26 may be integrated with hollow channel 30 to provide a receptacle for lid 50 when it is used to close container 20.

Lid 50, when used, covers container 20 in an airtight seal to keep food fresh and avoid freezer burn. More particularly, lid 50 is configured such that it clasps onto the flanges of inner wall lip 25 and/or outer wall lip 26 to essentially completely cover and seal the opening of the container 20. This may include, for example, the ability for the outer edge 54 of lid 50 to snap onto outer wall lip 26 while the inner edge 52 of lid 50 is pressed onto wider, more bulbous inner wall lip 25. It may also be advantageous for this snapping action to include an audible sound that signals the user that the container is properly sealed.

A cross-sectional illustrative view of this interaction between container 20 and lid 50 is shown in FIG. 10. Lid 50, for example, may contain a depression 70 located between the outer lip 54 and the inner lip 52, which could then be inserted into hollow channel 30 to further assist in providing a substantially airtight seal. Depression 70 may be configured to fit specifically into channel 30 (e.g., depression 70 may be formed to include a rounded edge that substantially matches the shape of barrier 32). Alternately, depression 70 may be formed of any shape that would be suitable for the task of assisting in maintaining an airtight seal. Moreover, depression 70 may be formed with built-in clips or other mechanisms that interlock with inner lip 25 and/or outer lip 26 to provide for an airtight fit with container 20.

Figure 11:
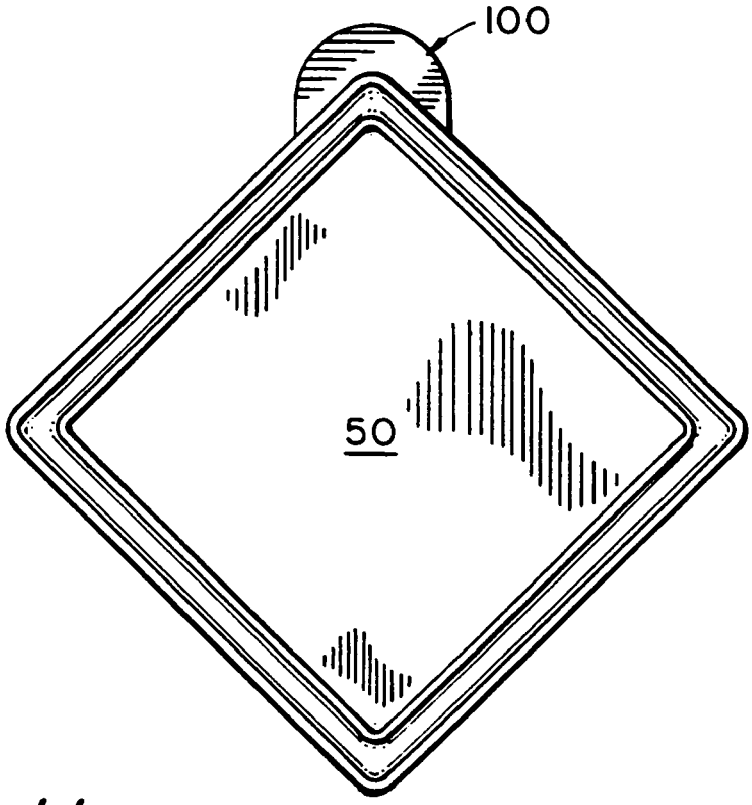
FIG. 11 is a schematic illustration of one embodiment of a lid of the food storage container of FIG. 1.

FIG. 11 shows an additional feature of lid 50 which provides assistance to users in opening up container 20. This feature may be particularly useful due to the fact that the container and lid may be frozen together. Thus, lid 50 may include at least one tab 100 which extends beyond the periphery of the body of container 20. Tabs 100 may be placed adjacent to one or more corners of lid 50, or placed anywhere between the corners of the lid 50, or both, to assist the user in opening container 20.

From the foregoing description, persons skilled in the art will recognize that this invention provides effective, efficient, food storage containers that give users the ability to label the containers without being concerned that the labels will become damaged during storage. It will also be recognized that the invention may take many forms other than those disclosed in this specification. Accordingly, it is emphasized that the invention is not limited to the disclosed methods and apparatuses, but is intended to include variations to and modifications thereof which are within the spirit of the following claims.

What is claimed is:

1. A food storage unit, comprising:

a container comprising a container top, a container bottom, an inner wall, and an outer wall having a fixed geometric relationship, said inner and outer walls forming a channel there between, said channel including a label container area that is in close proximity to said container top, said label container area that is accessibly by a user for the insertion of a label therein, at least a portion of said outer wall being translucent such that a label placed in said label container area may be read without being removed from said food storage unit; and a lid that may be fixably attached to said container top to seal said container CLOSED.

2. A food storage unit, comprising:

a container comprising a container top, a container bottom, an inner wall and an outer wall having a fixed geometric relationship, said inner and outer walls forming a channel there between, said channel including a label container area that in accessible by a user for the insertion of a label therein, at least a portion of said outer wall being translucent such that a label placed in said label container area may be read without being removed from said food storage unit;

at least one label support member that is located within said channel and is physically attached to said inner and outer walls, said label support member that prevents a label inserted into said label container area from falling to the bottom of said channel; and a lid that may be fixably attached to said container top to seal said container CLOSED.

3. The food storage unit of claim 2, wherein said label support member is positioned parallel to said lid between said inner wall and said outer wall.

4. The food storage unit of claim 2, wherein only one side of said channel is accessible by said user for said insertion of said label.

5. The food storage unit of claim 2, wherein said label, support member is positioned on one side of said container parallel to said lid between said inner wall and said outer wall, said label support member that provides a surface that a label would rest upon after being inserted into said label container area.

6. The food storage unit of claim 2, wherein said channel includes a portions that is inaccessible by said user, said container further comprising:

an insulating material located within said inaccessible portion of said channel.

7. The food storage unit of claim 6, wherein said label support member is positioned parallel to said lid between said inner wall and said outer wall, at least a portion of said insulating material being positioned below said label support member.

8. The food storage unit of claim 6, wherein said insulating material is polystyrene foam.

9. The food storage unit of claim 6, wherein said insulating material is plastic.

10. The food storage unit of claim 2, wherein said container further comprises:

support structure located between said inner wall and said outer wall that provides additional rigidity to said container.

11. The food storage unit of claim 10, wherein said label support member is positioned parallel to said lid between said inner wall and said outer wall, said label support member which renders a portion of space between said inner and outer wall inaccessible to said user, said container further comprising:

an insulating material located within said inaccessible portion of space.

12. The food storage unit of claim 2, wherein said outer wall is smaller in dimension at said container bottom than at said container top.

13. The food storage unit of claim 2, wherein said outer wall of said label container area comprises a translucent material.

14. The food storage unit of claim 2, wherein said lid further comprises a ridge that is insertable in between said inner wail and said outer wall.

15. The food storage unit of claim 14, wherein said ridge and said channel form a substantially airtight seal when mated together.

16. The food storage unit of claim 2, wherein said lid further comprises an opening-assistance tab.

17. The food storage unit of claim 2, wherein said container bottom further comprises a unified bottom structure that comprises a single wall.

18. The food storage unit of claim 2, wherein said lid comprises:

stacking support structure that may be engaged with a container bottom of another food storage unit to hold said food storage unit and said another food storage unit in alignment relative to each other.

* * * * *